United States Patent [19]

Brain

[11] Patent Number: 5,034,847

[45] Date of Patent: Jul. 23, 1991

[54] PORTABLE LIGHT BEACON

[76] Inventor: John E. Brain, 1017 Hyman Blvd., Apt. 303, Dollard des Ormeaux, Quebec, Canada, H9B 2L4

[21] Appl. No.: 263,075

[22] Filed: Oct. 27, 1988

[51] Int. Cl.[5] ..... F21L 7/00

[52] U.S. Cl. ..... 362/205; 362/84; 362/194; 362/208; 362/802; 340/321; 200/61.04

[58] Field of Search ..... 362/84, 194, 802, 208, 362/709; 441/36, 89, 13, 17, 18, 20; 200/61.04, DIG. 40, 61.06; 340/321

[56] References Cited

U.S. PATENT DOCUMENTS

| | | | |
|---|---|---|---|
| 2,323,064 | 6/1943 | Lustfield | 441/13 |
| 2,852,662 | 9/1958 | Garland | 362/205 |
| 3,264,463 | 8/1966 | Bonner | 240/10.66 |
| 3,278,921 | 10/1966 | Horino | 200/61.04 |
| 3,602,661 | 6/1971 | Liedberg | 200/61.05 |
| 3,914,813 | 10/1975 | Berchielli et al. | 441/18 |
| 3,953,905 | 5/1976 | Paitson | 9/8.3 |
| 4,063,323 | 12/1977 | Salvarezza | 9/14 |
| 4,144,557 | 3/1979 | Kerr, III et al. | 362/208 |
| 4,246,575 | 1/1981 | Purtell et al. | 200/61.04 |
| 4,428,033 | 1/1984 | McBride | 362/205 |
| 4,464,129 | 8/1984 | Vancheri | 4.1/16 |
| 4,628,420 | 12/1986 | McArthur | 362/208 |
| 4,680,682 | 7/1987 | Parker | 362/204 |
| 4,704,941 | 11/1987 | Reilly | 362/84 |

FOREIGN PATENT DOCUMENTS

| | | | |
|---|---|---|---|
| 192030 | 8/1919 | Canada . | |
| 381232 | 5/1939 | Canada . | |
| 703744 | 2/1965 | Canada . | |
| 2705920 | 8/1978 | Fed. Rep. of Germany | 362/84 |
| 1017139 | 8/1980 | United Kingdom . | |
| 2089015A | 7/1981 | United Kingdom . | |
| 2082126A | 3/1982 | United Kingdom . | |
| 2124744 | 2/1984 | United Kingdom | 362/84 |

*Primary Examiner*—Ira S. Lazarus
*Assistant Examiner*—Sue Hagarman
*Attorney, Agent, or Firm*—Shlesinger, Arkwright & Garvey

[57] ABSTRACT

A portable light beacon for use on life rafts and the like that has a long life due to a flashing light allowing the battery to recharge and a water sensing switch that once wet remains on. The light beacon comprises a portable battery power source in a water proof container, a flashing light with watertight electrical connections between the flashing light and the power source, and a fluid sensing switch comprising a fluid absorbent composition positioned between two terminals with circuitry to activate the flashing light when an electrical conductive fluid has been absorbed by the fluid absorbent composition to provide an electrical path between the two terminals.

32 Claims, 5 Drawing Sheets

PORTABLE LIGHT BEACON

The present invention relates to a light beacon for use on life jackets, life rafts and the like. More specifically, the present invention provides a portable light beacon having a light that operates when a water sensitive switch is immersed in water.

Existing light beacons, used to aid search and rescue operations, are usually powered by a water activated battery or cell, whereby the battery or cell chemistry is activated by the addition of water. Usually these types of light beacons feature an incandescent lamp for the light source. Once activated, the battery or cell must be considered used and discarded irrespective of whether the battery or cell electrical capacity has been exhausted. Consequently, there is no way to test the condition of the battery or cell without rendering the overall light beacon unserviceable. To activate the battery or cell one must manually remove a plug or plugs allowing water to enter the battery or cell via the then exposed port holes. International requirements call for specific luminous intensity of the activated light source, this being not less than 0.75 candela. Certain countries specify a luminous intensity of not less than 1 candela. The activated light source, at the required luminous intensity, must continue to operate for a minimum duration, usually eight or twelve hours, and must be visible over as great a segment of the upper hemisphere as is practable.

A new generation of emergency locating radio transmitters (ELT) and emergency positioning indicating radio beacons (EPIRB), operating at 406.025 MHz, are being developed for use with the search and rescue satellite-aided tracking system (SARSAT). The SARSAT system uses the doppler frequency shift created by the motion of the satellite relative to an activated transmitter to obtain accurate position determination of the ELT or EPIRB. COSPAS-SARSAT is an internationally coordinated program for a satellite-aided search and rescue system. The COSPAS-SARSAT system currently consists of low-altitude near-polar orbiting satellites. Once activated the ELT or EPIRB provides a digital transmitted message to the satellite which includes in the message data on user class (ship, aircraft etc.), country code, identification code and emergency code or elapsed time.

Existing Light and Radio beacons are mainly individual units. There are a few combined light and radio beacons, the radio, however, operating at the old standard frequencies of 121.5 MHz and/or 243 MHz. These existing units, whether a separate light and a separate radio beacon, or a combination of both in one unit, have a poor record with regard to their performance, reliability and durability. Problems encountered have been: battery or cell capacity exhausted due to long shelf life or exposure to humidity prior to activation, unreliable or difficult to operate activation systems, inadequate packaging, resulting in damage or failure of the units circuitry and batteries or cells, packaging material not being able to sustain without damage the harsh either hot, sub zero, humid or wet conditions, broken incandescent lamp filaments due to shock or vibration, failure of circuitry due to damage caused by handling, high voltage electro static discharges via exposed electrically conductive surfaces connected to the circuitry, electrical connecting cables being rigid or semi rigid or poor flexibility due to exposure in sub zero temperatures, electrical connectors having their terminals corrode or suffer due to exposure to humidity and/or salt or fresh water, electrical connectors and/or battery or cell water port hole plugs or switches being of such a design that their operation is impractable during a distress situation or requiring a degree of dexterity, force, or consciousness to operate which may not be possible by an injured person in a distress situation, poor emitted light intensity and not visible at the required amount of intensity over a large portion of the upper hemisphere for the required duration, material choices that are readily flammable and or are not self extinguishing, difficult or impractable battery or cell replacement, and absence of a simple reliable test procedure for the battery or cell and lamp without damaging the units seal integrity and or without rendering or risking rendering the unit unserviceable.

One problem that exists in many types of light beacons that are water activated, is that if they are removed from the water, for instance, if a person wearing a life jacket with a water activated light thereon, climbs into a life raft, then the light is extinguished.

The present invention provides a light beacon that has a fluid sensing switch which when wet, retains its moisture and thus continues to activate the light even when the switch itself is removed from the water. Preferably the present invention provides a portable light beacon that has a portable battery power source, such as a lithium cell powering a flashing light. It has been found that by having a flashing light rather than a constant light, the battery recovers its power loss between flashes and hence has a much longer life than when a constant light is powered from a single cell.

The present invention provides a portable light beacon comprising a portable battery power source in a water proof container, light means with watertight electrical connections between the light means and the power source, and a fluid sensing switch associated with the electrical connections, the sensing switch comprising a fluid absorbent composition positioned between two terminals with circuitry to activate the light means when an electrical conductive fluid has been absorbed by the fluid absorbent composition to provide an electrical path between the two terminals.

The portable battery power source may have a number of cell type chemistries, particularly a lithium cell, and it has been found that a lithium thionyl chloride battery provides greater cell capacity over other battery types for volume and weight. Furthermore, storage of such batteries at extreme operational temperatures is better than most other types of batteries.

The light beacon may be made in a number of component units joined together by flexible connectors, all of which are waterproof, and in a preferred embodiment a waterproof plug system is provided to connect the light to the power source. Furthermore, in another embodiment, a rotating switch which rotates in either direction about a container and has a number of positive locations, provides switch locations for automatic inspection, test, and off positions. In the inspection position, the light is on continuously rather than flashing.

The materials of construction are preferably a fluorocarbon resin such as that sold under the trade mark TEFLON, or a poly-sulphone which is a family of tough rigid high strength thermo-plastics. These materials maintain their properties at temperature extremes, typically $-100°$ C. to $+150°$ C. The material is resistant to oxidation and hydrolysis and withstands prolonged exposure to high temperature.

The light unit may be an incandescent or strobe light such as xenon. Alternatively, electroluminescent lights or fluorescent lights may be used. In the case of electroluminous lights, they are preferably in a series of strips and are flexible. In a still further embodiment, the light unit may be an LED emitting energy in the light range or the infrared range. In another embodiment, a radio beacon may be incorporated with the light beacon to operate on emergency frequencies powered by the portable battery power source included with the light beacon.

In drawings which illustrate embodiments of the invention:

FIG. 3 is a sectional side view showing the bottom portion of the portable light beacon of FIG. 1;

Figure 1:
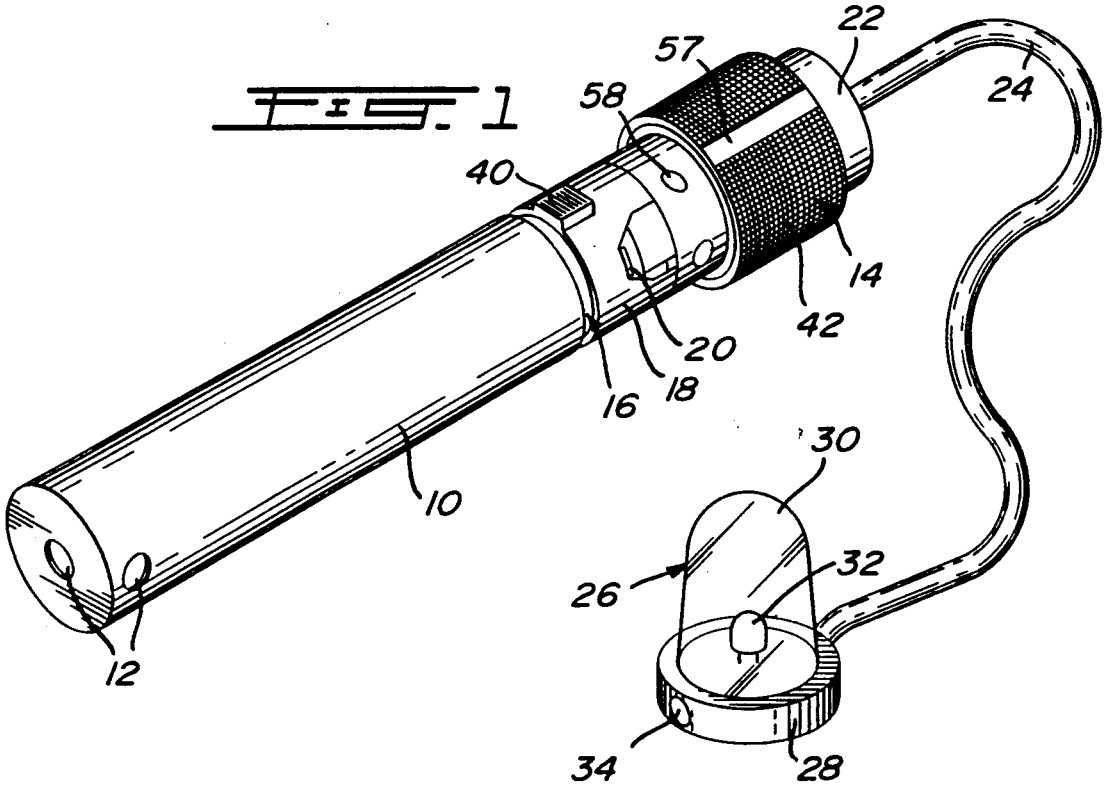
FIG. 1 is an isometric view of a portable light beacon according to one embodiment of the present invention.
Figure 2:
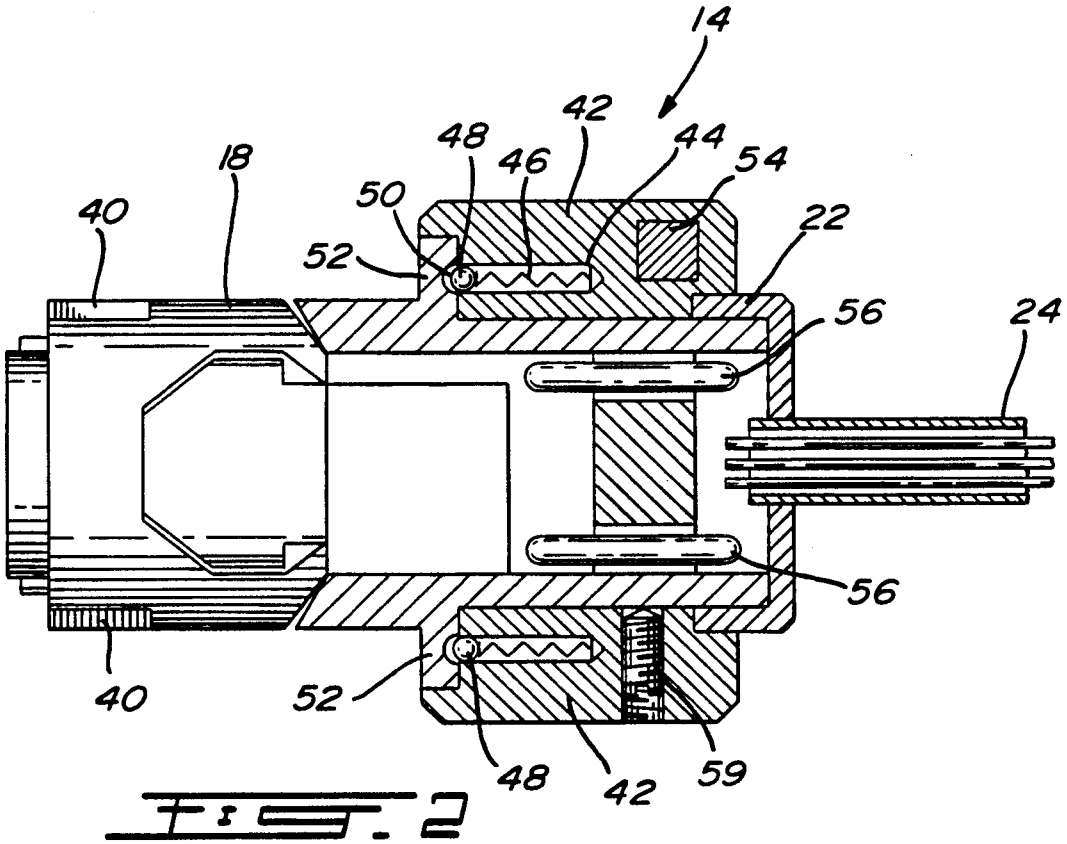
FIG. 2 is a sectional side view showing the top portion of the portable light beacon of FIG. 1.

Referring now to the drawings, FIGS. 1, 2 and 3 illustrate a portable light beacon comprising a bottom portion having a tube 10 with port holes 12 shown at one end to admit water, either sea water or fresh water, into a fluid sensing switch area. At the oppsite end from the port holes 12, is a top portion with a detachable connector 14 as shown in more detail in FIG. 2. A male connector assembly 16 on the tube 10 of the bottom portion fits into a female connector assembly 18 on the top portion and are latched together by tabs 20. A top cap 22 on the top portion, as shown in more detail in FIG. 2, has a hole at its center through which an electrical cable 24 passes to a separate light unit 26 comprising a base 28 and a lens 30 surrounding a light 32.

The light 32 is preferably flashing and it may be an incandescent, xenon, or florescent light. It may also be of the electroluminescent type as described in more detail hereafter. Circuits for operating the lamp which in one embodiment include a transistor circuit from the fluid sensing switch are included in the circular base 28. The transparent lens 30 is sealed to the base 28 for protection. In another embodiment, the light 32 may be an LED or a plurality of LED's which emit light or infrared energy.

A separate light sensitive device 34 such as a photoelectric cell that responds to changes in the ambient light levels is positioned in the circular base 28 to automatically ensure that the flashing light does not operate in daylight or when the ambient light is above a preset level. The light sensitive device controls the activation or deactivation of the light beacon. The components of the light beacon are all completely water proofed and sealed. The connector 14 between the top portion and the bottom portion has seals therein and may be connected and disconnected in adverse conditions.

The top connector 14 is shown in FIG. 2, has one or more integral press tabs 40 and the material is sufficiently flexible so that they may be pressed inwards to alter the circular shape of the connector to approximately oval, and thus releasing it from the tabs 20 on the male portion 16 of the tube 10. Electrical connectors (not shown) are provided within the male portion 16 and female portion 18 with O-rings for sealing to provide a waterproof connection.

FIG. 2 illustrates the top connector portion 14 having a circular ring 42 which rotates in either direction on the top connector 14 for a full 360°. The ring has a cylindrical aperture 44 therein which contains a spring 46 and ball 48 to engage in a series of indents 50 around a circular flange 52 forming part of the top connector 14. The indents 50 provide switch positions for the rotating ring 42. A permanent magnet 54 is shown located at one location in the ring 42 and a plurality of reed switches 56 are located inside the top connector portion 14 which are activated by the permanent magnet 54 when the ball 40 rests in a particular indent 50 of the flange 52. A luminous strip 57 is provided on the outside of the ring 42 as shown in FIG. 1 and symbols 58 or other marks are provided to indicate the switch position on the connector 14 beside the ring 42.

In one embodiment four switch positions are provided, a first position provides an automatic operation wherein the fluid sensing switch, either with or without a light sensing switch, activates the light. A second position is a test position to activate the flashing light, a third position is an inspection position which turns on the light continuously and a fourth position is an off position when the unit cannot be activated. A locking screw 59 shown in FIG. 2 allows the ring switch 42 to be locked in place.

FIG. 3 shows the lower portion with the tube 10 having a battery 60 therein and a container 62 for circuitry adjacent the male connector assembly 16. At the other end of the tube 10, in the fluid sensing switch area, two terminals 64 are spaced apart and have between them a fluid absorbent composition 66 such as cotton batt, wool batt, or non-woven synthetic batt, which absorbs liquid. In operation, when the absorbent material is in contact with an electrical conductive fluid, such as sea water and fresh water, then an electrical path occurs through this fluid which is retained in the absorbent composition 66 even when the unit itself is raised out of the water. Provided there is sufficient fluid therein to provide an electrical path between the two terminals 64, then the fluid sensing switch is turned on.

A reed switch 67 is illustrated in the circuitry container 62 and this is activated by a hand held magnet to provide a testing system when no ring switch unit is included in the light beacon. The read switch 67 turns on the flashing light only when a permanent magnet is placed at a test location to activate it.

Whereas FIG. 3 shows a male connector 16 at its top, it will be apparent that this may be replaced by a separate cap and the cable 24 brought straight into the tube 33. Thus in one embodiment, no rotary switch or detachable connectors are included in the light beacon.

Figure 5:
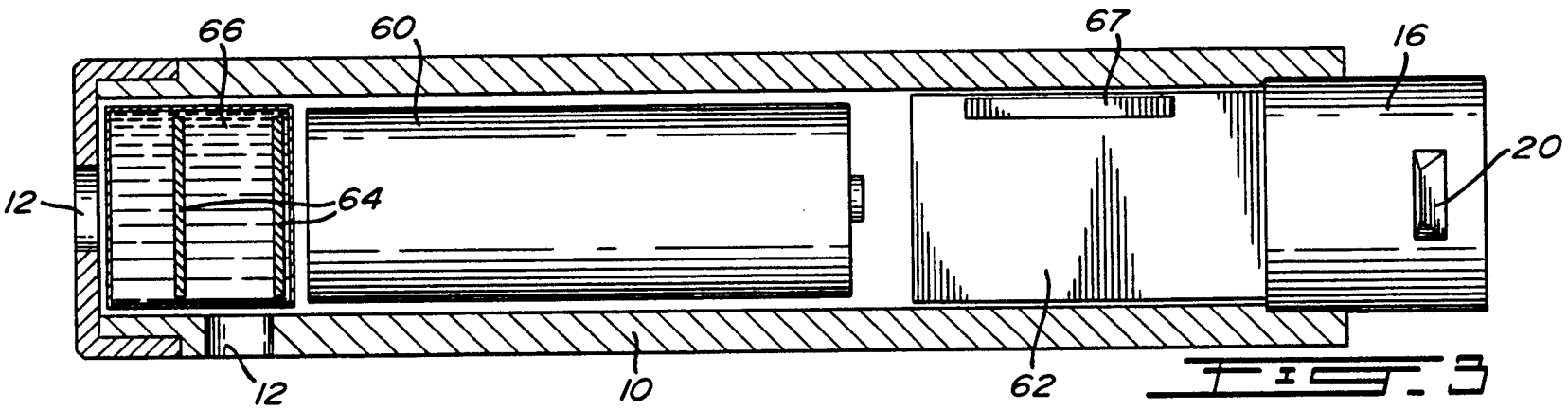
FIGS. 4 and 5 are partial isometric views showing detachable connectors for different units.
Figures 4, 5:
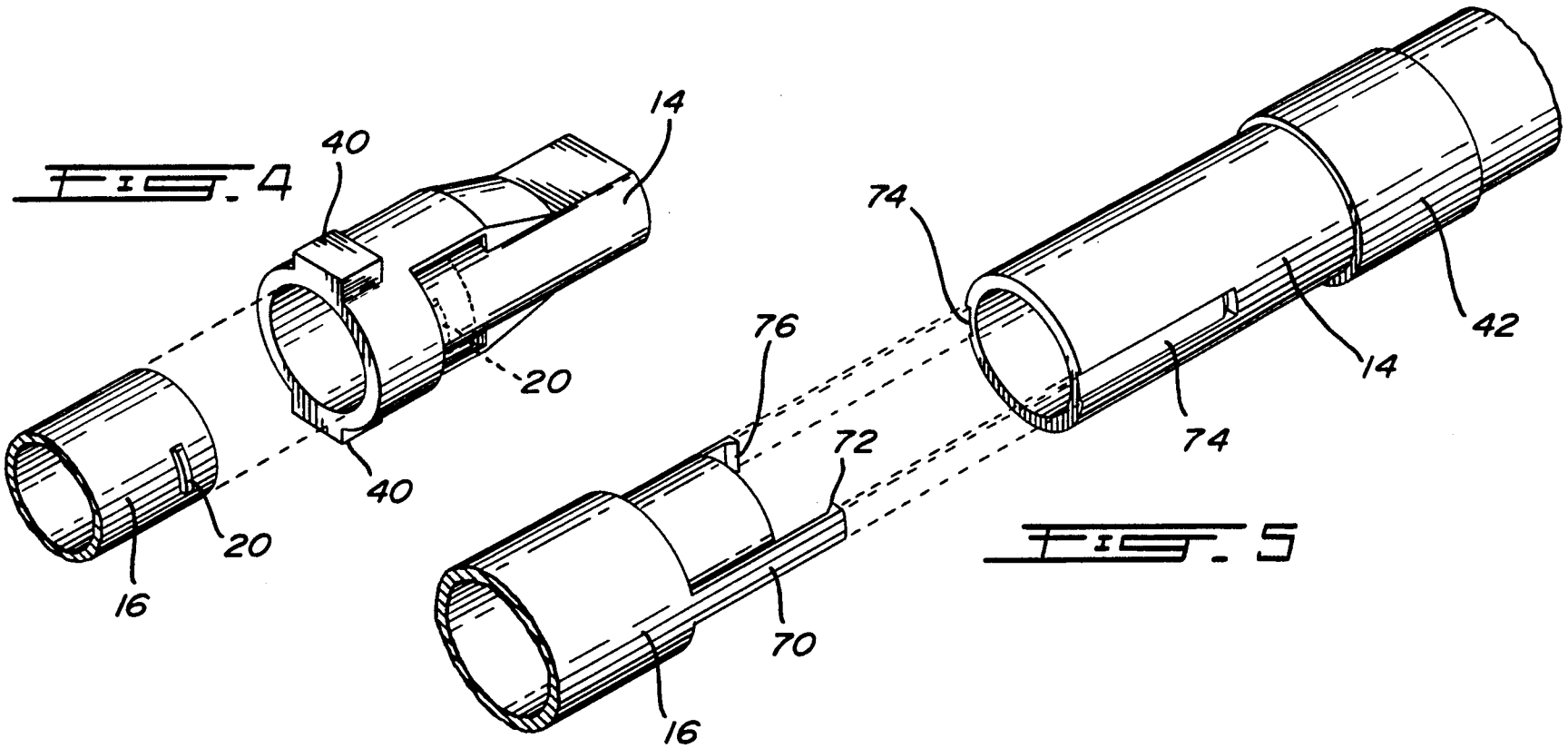

FIG. 4 illustrates a male connector assembly 16 and female connector assembly 14 similar to that shown in FIGS. 1 and 2, but without a rotary switch thereon. FIG. 5 illustrates another connecting system wherein the male connector assembly 16 is inserted into the female connector assembly 14 and has two side tabs 70 with detents 72 at the end to engage in slots 74 on the outside of the female connector 14.

Figure 6:
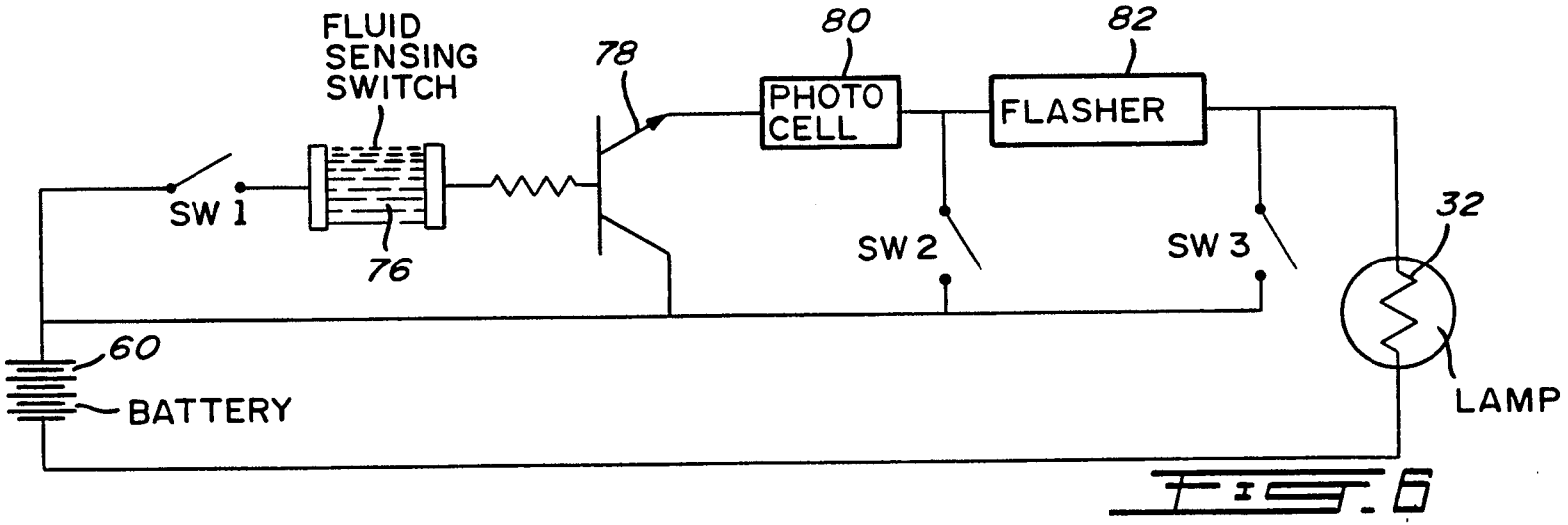
FIG. 6 is a schematic wiring diagram showing one embodiment of the wiring system including a fluid sensing switch for the portable light beacon of the present invention.

A typical circuit is illustrated in FIG. 6 wherein the battery 60 has a connection through SW1 being the unit off switch and the fluid sensing switch 76 to a transistor 78 having a resistor in the line so that when an electrical path is made, i.e. an electrical current can pass between the terminals of the fluid sensing switch 76 even be it small, due to high resistance in the fluid absorbing composition is made, the transistor is activated to provide power through the photocell 80, flasher 82 and to the light 32. SW2 is a test switch to operate the flasher and SW3 represents an inspection switch to turn on the light 32 and provide a continuous light.

Figure 7:
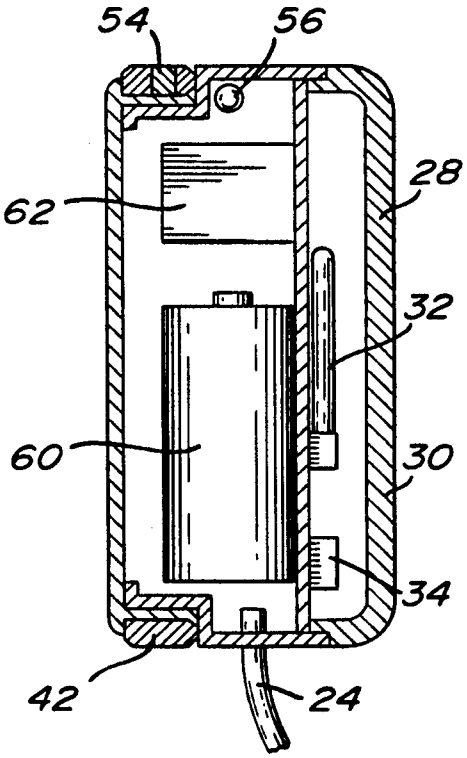
FIG. 7 is a cross sectional side view through another embodiment of a portable light beacon of the present invention.

FIG. 7 illustrates another embodiment of a light beacon wherein the light 32 is incorporated in the same container as the battery 60. A flat lens 30 covers the light 32 and inside the lens is a light sensitive switch 34. The unit is cylindrical in shape and has a switch ring 42 which rotates in either direction and has a ball and spring to engage in a series of detents on the switch body similar to that shown in FIG. 2. A permanent magnet 54 in the ring 42 activates reed switches 56 located at ring switch positions. An electrical connection cable 24 leads from the body of the unit to a separate fluid sensing switch of the type herein described.

A radio beacon circuit may be included within the electrical circuit container 62. The radio beacon being activated at the same time as the light 32 is activated.

Figure 8:
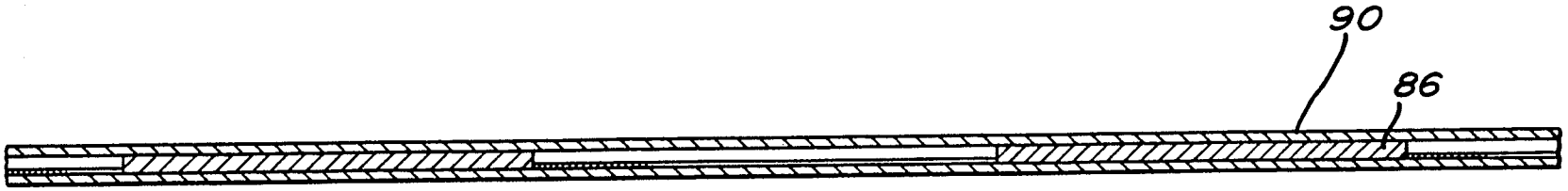
FIG. 8 is a sectional side view of an electroluminescent light strip according to one embodiment of the invention.
Figure 9:
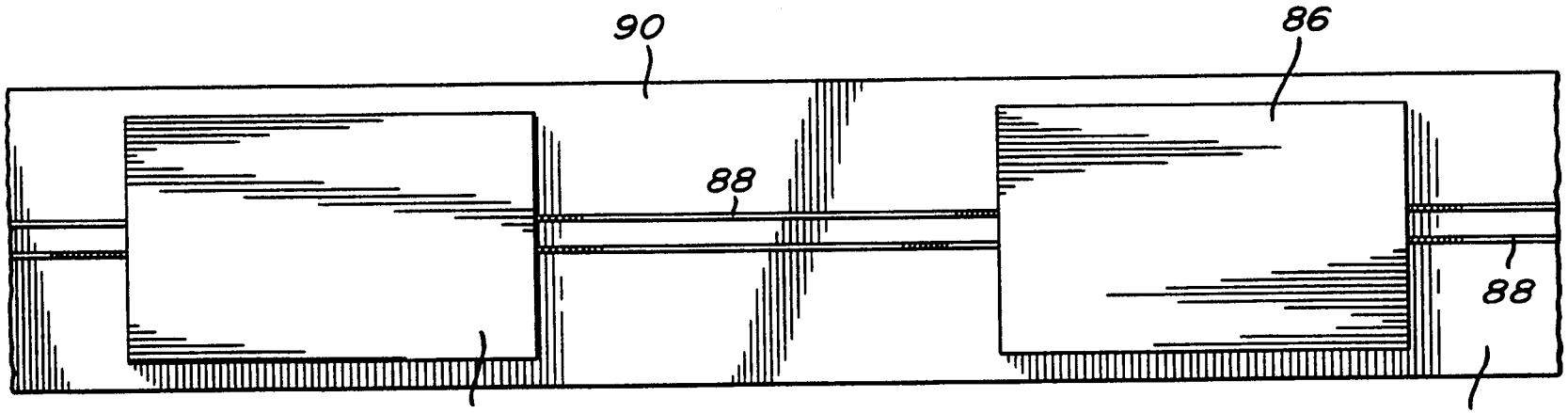
FIG. 9 is a plan view of the electroluminescent light shown in FIG. 8.

FIGS. 8 and 9 illustrate a typical layout of electroluminescent lights electrically connected to one another and contained within layers of flexible material to form a flexible flat light strip assembly. As can be seen, a plurality of lights 86 with connecting leads 88 are provided within envelope 90. Provision is made for the envelope to permit light and an optional light sensitive device may be provided for the same purpose as that described in the other embodiments of light beacon. The envelope 90 is a protective covering to seal the electroluminous light and may be made from silicone, fluorosilicone, fluorocarbon elastomeric compound. The two conducting surfaces of the electroluminescent light 86 which represent the electrodes, may either together or singularly be made from a combination of suitable electrical conductive silicone fluorosilicone or fluororcarbon elastomeric compound. In one embodiment, instructions may be included with the electroluminescent light so that when it is lit, the instructions can be read on a backing strip which may form part of the envelope 90. A plurality of these light strips may be joined together by cables and connectors similar to those shown in FIGS. 4 and 5 and a separate power source such as that shown in FIG. 1 provided.

Figure 10:
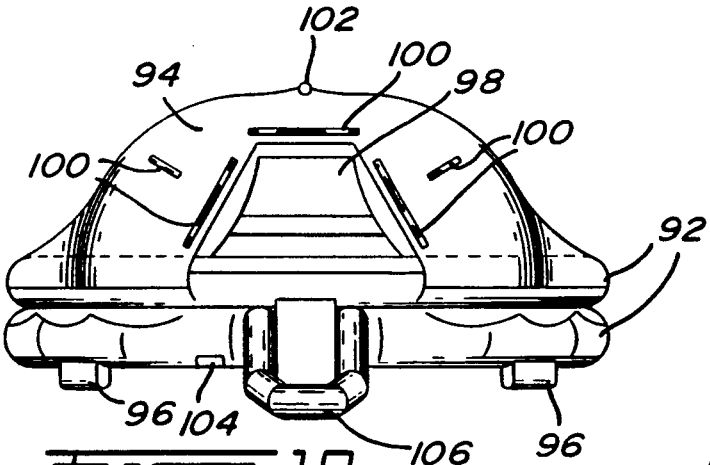
FIG. 10 is a front view of a typical life raft showing locations of light beacons and power source.

A typical life raft is illustrated in FIG. 10 for one or more persons which has buoyancy chambers 92 supporting a canopy 94. Water stabilizing pockets 96 are attached to the lower bouyancy chambers 92. A doorway 98 permits access within the canopy and a plurality of electroluminescent light strips 100 are positioned about the doorway 98. An incandescent light beacon 102 which provides a high intensity light is provided on top of the life raft. The power source and fluid sensing switch unit 104 is located on the base of the lower buoyancy chamber 92 so that it is immersed and the fluid sensing switch is activated. A boarding ramp 106 is illustrated and further electroluminescent strips may be provided on the boarding ramp if desired.

Figure 11:
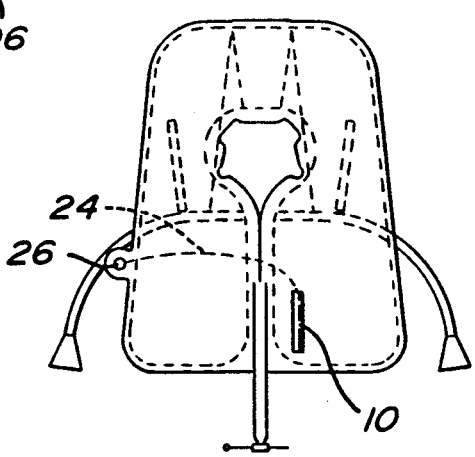
FIG. 11 is a front view of a typical life preserver showing locations of light beacon and power source.

A life jacket is illustrated in FIG. 11 wherein the light unit 26 has an electrical connecting cable 24 to the combined power unit and fluid sensing switch 10.

Various changes may be made to the embodiments described herein without departing from the scope of the present invention which is limited only by the following claims.

The embodiments of the invention in which an exclusive property or privilege is claimed are defined as follows:

1. A portable light beacon comprising:

a portable battery power source in a water proof container;

light means connected by an electrical path to said battery power source, a fluid sensing switch located in said electrical path between the light means and the power source said fluid sensing switch including a fluid absorbent medium positioned between a pair of terminals which are in said electrical path; and an electronic circuitry in said electrical path, constituting means for sensing a relatively weak electrical current between said terminals occurring when electro-conductive fluid has been absorbed by said medium, and for activating said light means in response to said current.

2. A portable light beacon, as defined in claim 1, wherein said light means is a flashing light means.

3. The portable light beacon according to claim 2 wherein the circuitry for the fluid sensing switch comprises a transistor and resistance.

4. The portable light beacon according to claim 2 wherein the fluid sensing switch is contained in a container housing the portable battery source and has at least one port for admitting fluid.

5. The portable light beacon according to claim 2 including a light sensing switch means to prevent activation of the flashing light means when ambient light is above a preset level.

6. The portable light beacon according to claim 2 wherein the fluid absorbing medium in the sensing switch is material selected from the group consisting of cotton batt, wool batt, and non-woven synthetic fibre batt.

7. The portable light beacon according to claim 2 including a testing system comprising a reed switch activated by a separate magnet, the reed switch activating the flashing light means.

8. The portable light beacon according to claim 2 including a radio beacon incorporated therein activated by the fluid sensing switch when the flashing light means is activated.

9. The portable light beacon according to claim 2 wherein the flashing light means is a strobe light.

10. The portable light beacon according to claim 2 wherein the flashing light means is an incandescent light.

11. The portable light beacon according to claim 2 wherein the flashing light means is an LED.

12. The portable light beacon according to claim 11 wherein the LED emits energy in the infrared range.

13. The portable light beacon according to claim 2 wherein the power source and flashing light means are incorporated within one container, and the fluid sensing switch is a separate unit with a flexible connector therebetween.

14. The portable light beacon according to claim 13 including a ring switch about the periphery of the container, the ring switch being rotatable in either direction for 360° and having a plurality of positive switch positions.

15. The portable light beacon according to claim 2 wherein the portable battery power source is a lithium cell battery.

16. The portable light beacon according to claim 15 wherein the lithium cell battery is a lithium thionyl chloride battery.

17. The portable light beacon according to claim 2 wherein the power source and fluid sensing switch are incorporated in one unit and the flashing light means is incorporated in another unit with a flexible connector therebetween.

18. The portable light beacon according to claim 17 wherein a waterproof quick connect coupling means is provided to join the flexible connector to the unit containing the power source and fluid sensing switch.

19. The portable light beacon according to claim 17 wherein the units are formed of fluoropolymer materials.

20. The portable light beacon according to claim 17 wherein the units are formed of polysulphone materials.

21. The portable light beacon according to claim 17 wherein the flashing light means comprises a plurality of electroluminescent light strips.

22. The portable light beacon according to claim 21 wherein the electroluminescent light strips are arranged around a canopy doorway of a life raft.

23. The portable light beacon according to claim 21 wherein the electroluminescent light strips have at least one conducting surface forming an electrode made of material selected from the group consisting of electrically conductive silicone, fluorosilicone, and fluorocarbon elastomeric compounds.

24. The portable light beacon according to claim 21 wherein the electroluminescent light strips are flexible.

25. The portable light beacon according to claim 21 wherein the electroluminescent light strips are contained within a translucent protective covering.

26. The portable light beacon according to claim 25 wherein the translucent protective covering is made of material selected from the group consisting of silicone, fluorosilicone and fluorocarbon elastomeric compounds.

27. The portable light beacon according to claim 17 wherein the unit containing the power source and fluid sensing switch is cylindrical and has a rotatable ring switch thereon rotatable in either direction through 360°, the switch having positions for (1) automatic operation when the fluid sensing switch activates the flashing light means (2), test position for operating flashing light means (3), inspection position for continuous light, and (4) off position.

28. The portable light beacon according to claim 27 wherein the rotatable ring switch includes a rotatable ring with a permanent magnet therein to activate at least one reed switch at a switch position.

29. The portable light beacon according to claim 27 including a ball and spring in a cylindrical cavity, the ball engaging in a detent at each switch position.

30. The portable light beacon according to claim 27 including a luminous strip on the rotatable ring switch to indicate the switch position.

31. The portable light beacon according to claim 27 including a locking means to lock the rotatable ring switch in at least one switch position.

32. A portable light beacon, comprising:

a battery in a water proof container;

light means;

electrical connection means between said light means and said battery, said electrical connection means, battery and light means forming an electrical circuit;

a fluid sensing switch in said electrical circuit, said fluid sensing switch including:

a) a pair of terminals coupled to said electrical connection means; and b) a fluid retaining medium between said terminals, said fluid sensing switch constituting means for:

i) establishing an electrical path between said terminals when said fluid sensing switch is immersed in an electro-conductive fluid, thereby allowing a relatively weak electrical current to flow between the terminals;

ii) maintaining the flow of electrical current between said terminals when said fluid sensing switch is removed from the electro-conductive fluid, by retaining between said terminals a quantity of electro-conductive fluid to maintain said electrical path; and an electronic circuit means in said electrical circuit, for activating said light means in response to said electrical current.

* * * * *